United States Patent [19]

McIntyre

[11] Patent Number: 4,705,248

[45] Date of Patent: Nov. 10, 1987

[54] FLUID COLLECTION AND DISPOSAL APPARATUS

[76] Inventor: Jonothon M. W. McIntyre, 13535 Valerio St., Apt. 113, Van Nuys, Calif. 91405

[21] Appl. No.: 878,025

[22] Filed: Jun. 24, 1986

[51] Int. Cl.[4] ..... B65B 67/12

[52] U.S. Cl. ..... 248/99; 184/1.5

[58] Field of Search ..... 141/10, 314, 316, 337, 141/338, 390, 391; 184/1.5, 106; 220/404; 248/150, 152, 94, 97, 99, 100, 101

[56] References Cited

U.S. PATENT DOCUMENTS

| | | | |
|---|---|---|---|
| 3,595,507 | 7/1971 | Kurlander | 248/97 |
| 3,610,560 | 10/1971 | Harris | 248/97 |
| 3,983,914 | 10/1976 | Benson | 141/390 |
| 4,022,257 | 5/1977 | O'Connell | 141/314 X |
| 4,064,969 | 12/1977 | Black | 248/99 X |
| 4,332,282 | 6/1982 | Strange | 141/1 |
| 4,338,979 | 7/1982 | Dow | 141/10 |
| 4,485,853 | 12/1984 | Gunderson | 141/1 |
| 4,512,463 | 4/1985 | Ward | 141/337 X |
| 4,610,039 | 9/1986 | Stern | 141/390 X |

*Primary Examiner*—Henry J. Recla
*Assistant Examiner*—Mark J. Thronson
*Attorney, Agent, or Firm*—Kelly, Bauersfeld & Lowry

[57] ABSTRACT

A device which may be conveniently utilized to collect oil drained from an engine crankcase includes a fluid impermeable plastic bag and a rigid drain stand. The drain stand is designed to hold the bag below the oil drain in a manner facilitating flow of oil into the bag while simultaneously preventing larger objects, such as the drain plug, from also falling into the bag. This drain stand is further preferably constructed of a single sheet of corrugated fiberboard material which may be shipped or sold in a flattened or collapsed configuration, and then unfolded and assembled with the bag by the end user. A unique locking mechanism is provided for joining portions of the corrugated fiberboard sheet without adhesives to form a strong, rigid structure. After the oil has been completely drained into the bag, the bag can be removed from the drain stand, sealed, and then disposed of in an ecologically sound and safe manner.

19 Claims, 16 Drawing Figures

FIG. 5
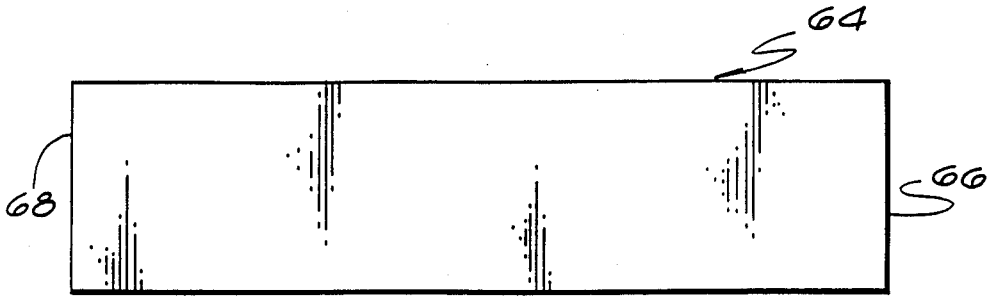
FIG. 6
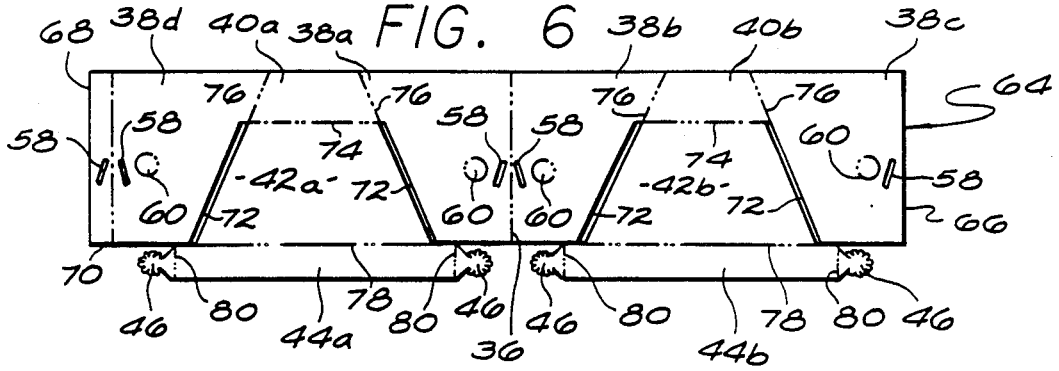
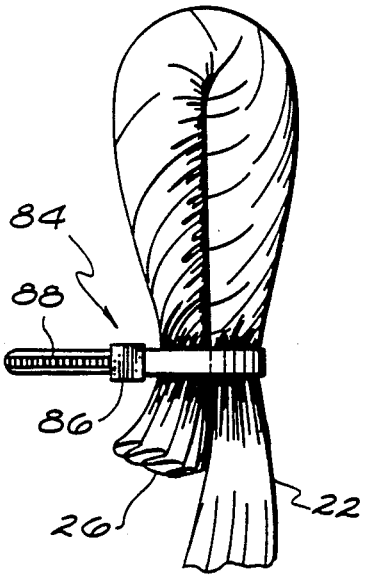
FIG. 16
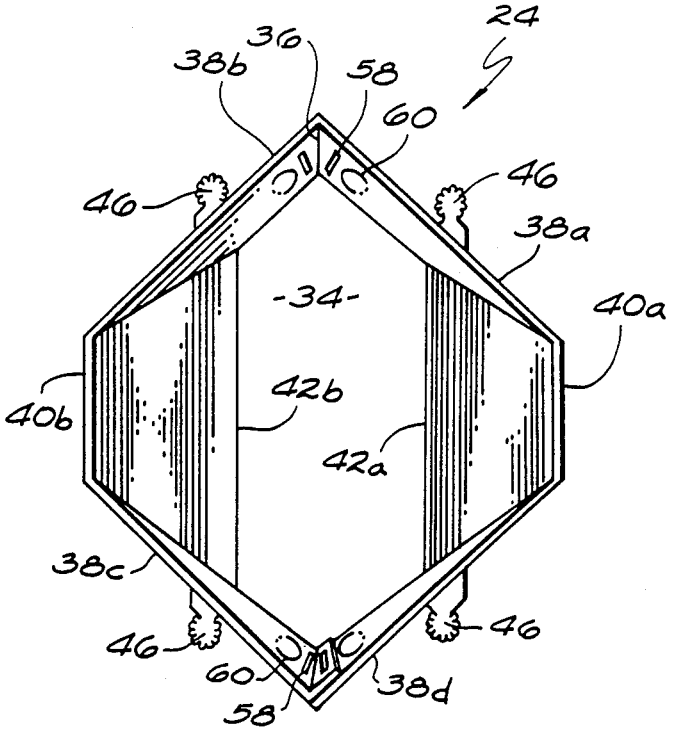
FIG. 7

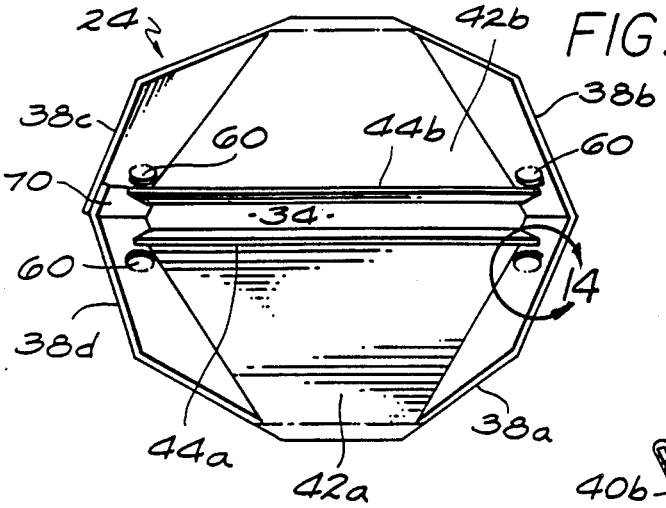
FIG. 10
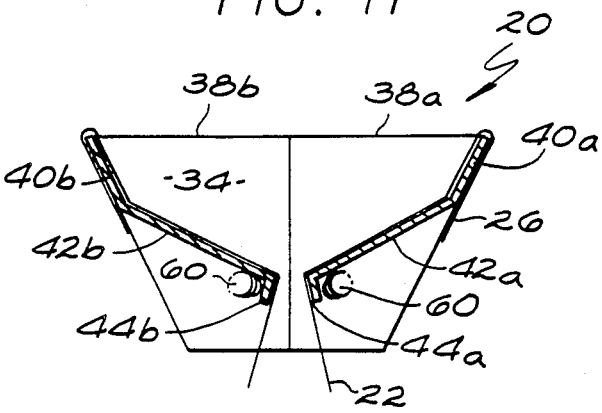
FIG. 11
FIG. 12
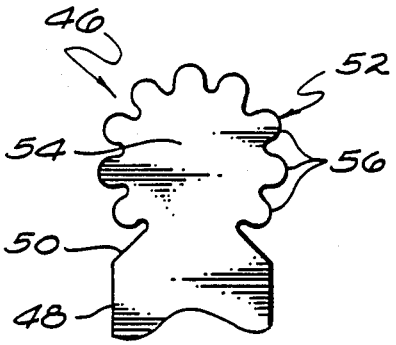
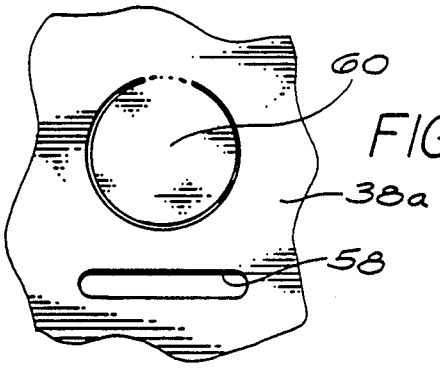
FIG. 13
FIG. 14
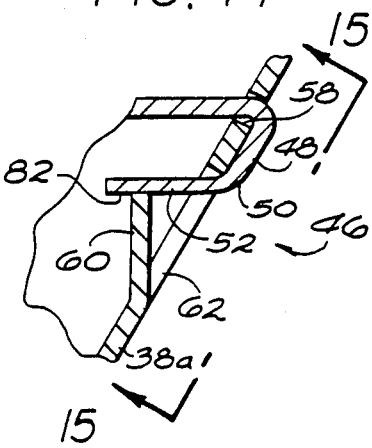
FIG. 15
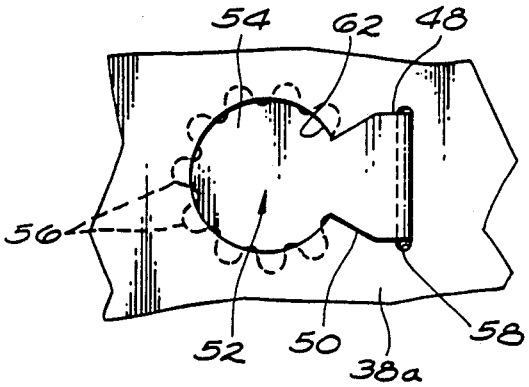

FLUID COLLECTION AND DISPOSAL APPARATUSR

BACKGROUND OF THE INVENTION

This invention relates generally to the collection and disposal of fluids, and, more specifically, to lightweight and easy to manufacture devices utilized to collect fluids, such as hazardous wastes, and which also provide for convenient disposal of the collected fluids.

Fluid collection and disposal systems often resemble devices utilized to collect engine crankcase oil. In the most basic form, fluid collection devices are constructed to simply form a collection basin or container for retaining the drained fluids within a confined area.

Since many of the fluids routinely drained from machines and the like, are classified as hazardous wastes, the need has arisen for systems which can accommodate disposal of such hazardous wastes in a clean, efficient and ecologically sound manner. In this regard, gasoline service stations now routinely accept used engine crankcase oil, and they often provide a dedicated waste oil barrel for this purpose. A problem exists for the home mechanic, however, in transporting used oil to the recycling bin or station.

In an attempt to overcome this problem, various devices have been designed which funnel the used oil into an encloseable container. For example, one proposed solution has been to provide a raised collection reservoir which can be situated beneath a drain plug for receiving oil draining from a crankcase. The bottom surface of this collection reservoir slopes downwardly to a central aperture where the oil is funnelled into a plastic collection bag. After fluid drainage is complete, this collection bag can be sealed and then transported to the recycling bin.

Another attempt to solve the problem of transporting used oil to a recycling center involves the provision of a rigid container having the equivalent of an oil pan formed in the side thereof. In use, this container is laid on its side with the oil pan facing upwardly and placed immediately below the drain. A container drain plug is removed from an aperture at the bottom of the integral oil pan, and oil impinging onto the oil pan surface is funnelled through the aperture into the rigid container. After collecting the oil within the container, the plug can be replaced and the oil transported inside of the container to the recycling station for safe disposal.

Although the foregoing represent improvements to the basic open top collection basin, problems exist which make present collection and disposal systems less than ideal. For example, in both of the above discussed devices, the oil pan itself should be cleaned after use. This is often a very messy and objectionable task. Further, the devices presently available tend to be bulky, difficult to use, and to lack a desired level of consumer acceptance which would place them in widespread use.

Accordingly, there has been a need for a fluid collection and disposal apparatus which is inexpensive, convenient to use, and provides a safe and efficient means for properly disposing of fluids such as engine crankcase oil. Additionally, there has been a need for a device which eliminates clean-up of parts after the fluid has been drained, and which provides apparatus for conveniently transporting the drained fluid to a recycling station. A need further exists for a fluid collection and disposal apparatus which can be shipped in a flat condition, unfolded quickly for use, constructed of a material such as corrugated fiberboard, and ultimately thrown away after use. Moreover, a need exists for such an apparatus which can be utilized by manufacturers to promote other related goods, such as motor oil, in an inexpensive manner, and which appeals to the public. The present invention fulfills these needs and provides other related advantages.

SUMMARY OF THE INVENTION

The present invention resides in an improved fluid collection and disposal apparatus which provides a safe and efficient means for transporting and disposing fluids such as used engine crankcase oil. The novel apparatus of the present invention comprises generally a fluid impermeable bag-like enclosure means for receiving and holding fluids to be collected, and a collapsible drain stand for holding the enclosure means in a manner facilitating flow of fluids to be collected into the enclosure means.

The drain stand includes means for engaging an open end of the enclosure means to hold it in an open, fluid receiving position. Further, means are provided for funneling fluid drained through the enclosure means open end to the remainder of the enclosure means in a manner preventing larger solid objects from entering the enclosure means. Moreover, the drain stand includes means for positioning the engaging means and the funneling means to ensure that substantially all of the fluids to be collected drain into the enclosure means.

In a preferred form of the invention, the drain stand is constructed from a generally rectangular piece of flat, rigid base material folded along a mirror-image fold line perpendicular to the long axis of the base material. The mirror-image fold line provides a reference from which the base material is cut and folded, whereby a cut or fold on one side of the mirror-image fold line is generally duplicated on the other side of the mirror-image fold line. The free ends of this base material are secured to one another, and the two oppositely facing sides of the base material are separated from one another except for attachment at the mirror-image fold line and the secured free ends. This separation creates a definable drain stand interior.

The bottom side of the base material is cut to form, on each side of the mirror-image fold line, a pair of drain stand legs, an enclosure means guide panel, and a locking tab at each end of the guide panel. The mid-section of the base material is further cut to form, again on each side of the mirror-image fold line, an inner support panel connected at its upper end to the remainder of the base material but separated along its sides from the base material. The inner support panel is connected at its lower end to the guide panel.

The inner support panels are bent upwardly into the drain stand interior to create the aforementioned means for funneling fluid, and then the inner support panels are secured in a desired position by engaging the locking tabs with means for securing the locking tabs to the remainder of the base material. More specifically, the locking tab and the securing means define a unique locking mechanism for joining the guide panel to the remainder of the base material without adhesives. The locking tab includes a strap extending from the guide panel, and a locking tab head connected to the strap. The securing means comprises generally a slot provided through the remainder of the base material which is dimensioned to permit passage of the strap and the locking head therethrough, and an aperture adjacent the slot which has slightly smaller dimensions than the locking tab head.

In use, the locking tab head and the strap are passed through the slot, and then the strap is bent to place the locking tab head next to the aperture. The locking tab head is then pushed through the aperture in a manner deforming the locking tab head as it passes through the aperture, but permitting the locking tab head to resiliently resume a shape having dimensions larger than those of the aperture. In the illustrated embodiment, the locking tab heads are provided a plurality of nodules about their outer periphery, the base of the nodules being positioned to easily pass through the adjacent aperture. The nodules, however, have sufficient length and rigidity to resist reverse passage through the aperture when the pushing force is removed. Further, a locking tab anchor hinged to one side of the aperture, is provided. This anchor engages the locking tab head after it is pushed through the aperture to prevent its passage back through the aperture.

Once the base material has been unfolded and properly constructed to form the rigid drain stand, the enclosure means or bag is passed from the bottom of the stand through its interior between the interior support panels, and the upper open end of the bag is stretched over the upper edge of the stand. Fluid can then be drained into the bag, and upon completion of the draining operation, the bag can be conveniently removed from the stand, sealed, and transported to a recycling station. If done properly, there is no clean-up of oil from the stand.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 5 is an elevational view of the base material similar to that illustrated in FIG. 2, but illustrating the base material in an unfolded condition;

FIG. 6 is an elevational view of the unfolded base material illustrated in FIG. 5, showing how that base material would be cut to form the drain stand of the present invention prior to being folded along the mirror-image fold line;

FIG. 7 is an enlarged top plan view of the collapsible drain stand of FIGS. 2-6, illustrating the manner in which the drain stand is constructed by pulling apart opposite sides of the base material, and folding a pair of oppositely situated inner support panels upwardly into the interior of the drain stand;

FIG. 10 is a bottom plan view taken generally along the line 10—10 of FIG. 9;

FIG. 11 is an elevational sectional view taken generally along the line 11—11 of FIG. 9, and further illustrating the manner in which a fluid impermeable bag is positioned on the drain stand for collecting fluids;

FIG. 12 is an enlarged plan view of a locking tab;

FIG. 13 is an enlarged plan view of a portion of the drain stand which, in connection with the locking tab illustrated in FIG. 12, forms a unique locking mechanism for joining a first member to a second member without adhesives;

FIG. 14 is an enlarged sectional view taken generally along the line 14—14 of FIG. 10, illustrating with particularity the manner in which the locking tab is inserted into the side of the drain stand;

FIG. 15 is an elevational view taken generally along the line 15—15 of FIG. 14; and FIG. 16 is an enlarged pespective view of a perferred manner of tying off the upper open end of a fluid collection bag to prevent fluid leakage.

DETAILED DESCRIPTION OF THE PREFERRED EMBODIMENT

Figure 1:
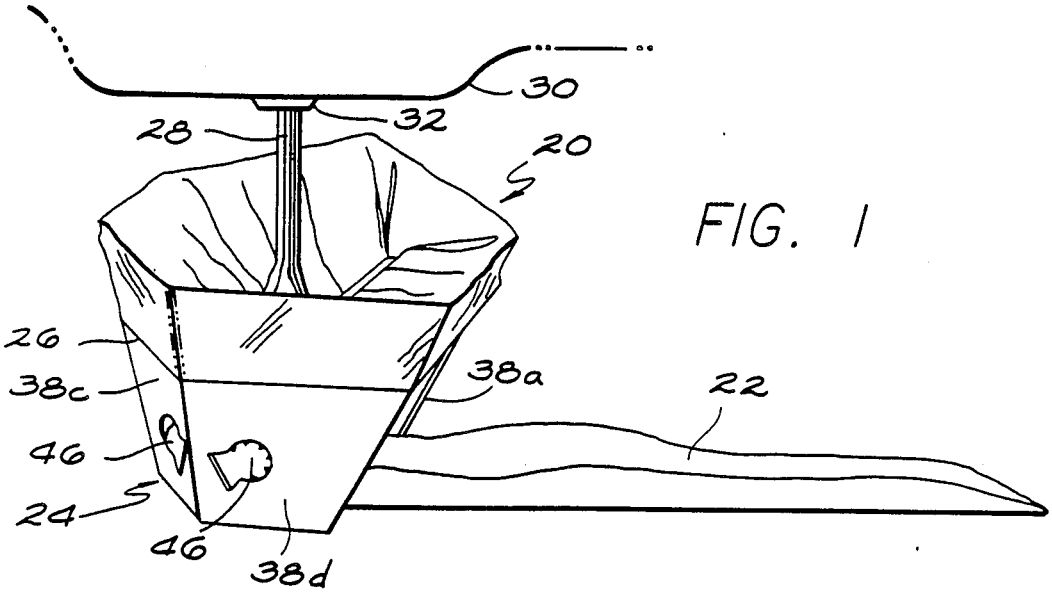
FIG. 1 is a perspective view of a preferred form of the fluid collection and disposal apparatus of the present invention, illustrating the apparatus as it may be used to collect oil draining from an engine crankcase.

As shown in the drawings for purposes of illustration, the present invention is concerned with a novel fluid collection and disposal apparatus, generally designated in FIG. 1 by the reference number 20. This improved fluid collection and disposal apparatus 20 comprises a fluid impermeable plastic bag 22, and a collapsible drain stand 24 for holding the bag 22 in a manner facilitating flow of fluid to be collected into the bag. To this end, the drain stand 24 includes means for engaging the open end 26 of the bag 22 to hold it in an open, fluid receiving position. Additionally, means are provided for funneling fluid drained through the open end 26, to the remainder of the bag 22 in a manner preventing larger solid objects from entering the bag. Further, means are provided for positioning the drain stand 24 in an appropriate position beneath a drain.

The improved fluid collection and disposal apparatus 20 of this invention is designed to be shipped in a flat condition, unfolded quickly for use, and is inexpensive to the degree that it is ultimately disposable. It is preferred that the drain stand 24 be constructed from a generally rectangular piece of flat, rigid base material which, in connection with the bag 22, provides an apparatus which is convenient to use, and which provides a safe and efficient means for properly disposing of fluids such as engine crankcase oil.

In accordance with the present invention, and as best illustrated in FIGS. 1 and 9-16, the bag 22 is preferably constructed of flexible polyethylene to have a tubular gusseted design. When intended for use in the collection and disposal of engine crankcase oil, the bag 22 should have approximately a ten quart volumetric capacity to accommodate virtually all anticipated applications. The drain stand 24 is preferably constructed of a corrugated fiberboard material having a one sixteenth inch cross-sectional dimension. It has been found that such material exhibits all the necessary structural capabilities for convenient and reliable use, yet it is durable enough to withstand the stresses and strains normally imposed on the drain stand 24 during normal use. Further, it should be understood that other materials may be used for the drain stand 24, such as double weight gauge chipboard or resilient plastic sheeting.

As shown in FIG. 1, the illustrated fluid collection and disposal apparatus 20 may be used to conveniently collect oil 28 drained from an oil pan 30 beneath an automobile (not shown) through a drain 32. The open end 26 of the bag 22 is stretched over the upper edge of the drain stand 24 in order to collect the oil 28 as it flows from the drain 32. The drain stand 24 is constructed so that the bag may extend downwardly through the interior 34 of the drain stand 24, and outwardly from the drain stand as needed to accommodate the length of the bag 22.

Figure 9:
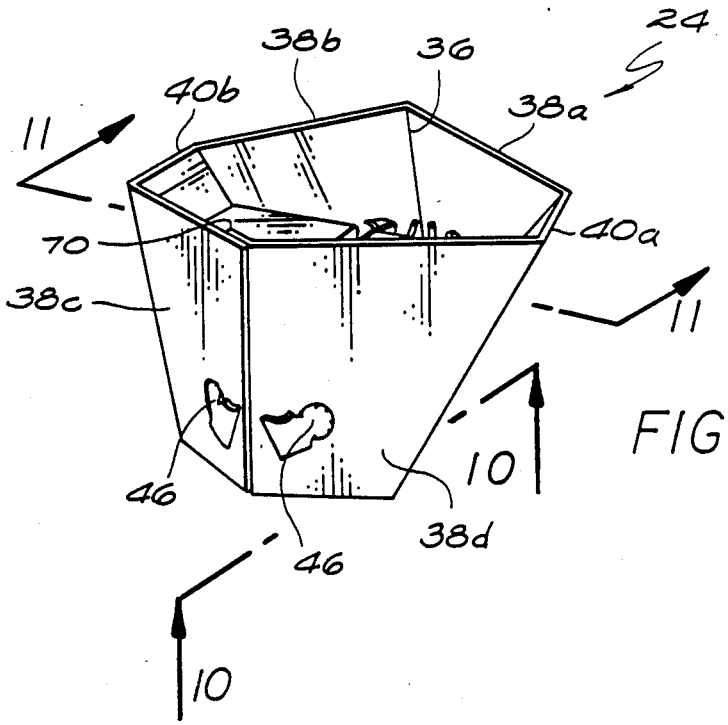
FIG. 9 is another perspective view of the collapsible drain stand, illustrating the manner in which the locking tabs are secured in place to complete assembly of the drain stand.

Referring now more particularly to FIGS. 9–11, the drain stand 24 is preferably constructed of a single rectangular piece of base material folded along a mirror-image fold line 36, and having its free ends glued to one another. The drain stand 24 includes four side wall panels 38*a–d*, and a pair of end wall panels 40*a* and 40*b* situated between two of the side wall panels 38. These side wall panels 38*a–d* provide the primary ground support for the fluid collection and disposal apparatus 20, and function as drain stand legs. These side wall panels 38*a–d*, together with the end wall panels 40*a* and 40*b*, further form the upper edge of the drain stand 24, which engages the bag 22 in a manner more fully described below.

The drain stand 24 additionally includes a pair of inner support panels 42*a* and 42*b* which are attached and extend downwardly from a respective one of the end wall panels 40*a* and 40*b*. These inner support panels 42*a* and 42*b* slope downwardly from the respective end wall panel 40*a* or 40*b*, and inwardly toward one another to create a trough sufficiently wide to permit fluid to flow easily therethrough, yet narrow enough to prevent larger solid objects from falling therethrough. Where it is intended that engine oil 28 will be the primary fluid collected by the fluid collection and disposal apparatus 20, the trough would be sized to permit the liquid oil to easily flow through the trough, and yet narrow enough to prevent a drain plug (not shown) from falling past the inner support panels 42*a* and 42*b*.

Attached to the lower edge of the inner support panels 42*a* and 42*b* are disposal bag guide panels 44*a* and 44*b* which facilitate passage of the open end 26 and adjacent portions of the bag 22 through the trough from the lower side of the drain stand 24. These guide panels 44*a* and 44*b* extend downwardly and slightly outwardly from their attachment point to the inner support panels 42*a* and 42*b* as best shown in FIG. 11.

Each lateral end of these guide panels 44*a* and 44*b* support a locking tab 46 which includes a strap portion 48, a narrowed locking tab neck portion 50, and a locking tab head 52. The locking tab head 52 further includes a solid circular base portion 54, and a plurality of nodules 56 which extend outwardly from the base portion 54. These locking tabs 46 interact with a corresponding slot 58 through an adjacent side wall panel 38, and a locking tab anchor 60 hinged to an aperture 62 situated near the slot 58.

Figure 2:
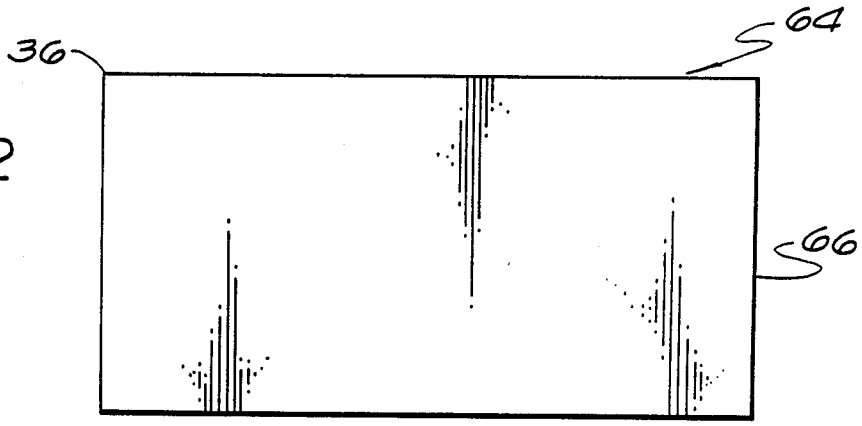
FIG. 2 is an elevational view of a generally rectangular piece of flat, rigid base material from which a drain stand of the present invention is constructed, the base material being shown as folded along a mirror-image fold line.
Figure 3:
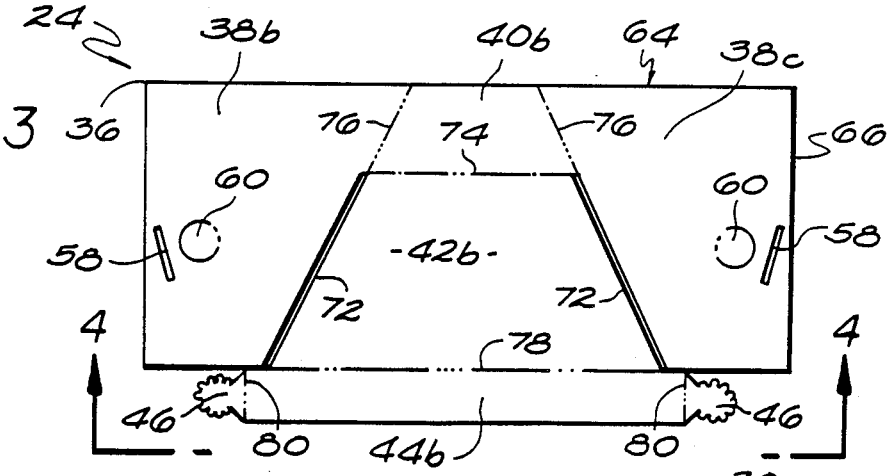
FIG. 3 is an elevational view of the sheet of base material illustrated in FIG. 2, showing the manner in which that folded base material is cut to form the collapsible drain stand for holding a bag in a manner facilitating the flow of fluids to be collected into the bag.
Figure 4:
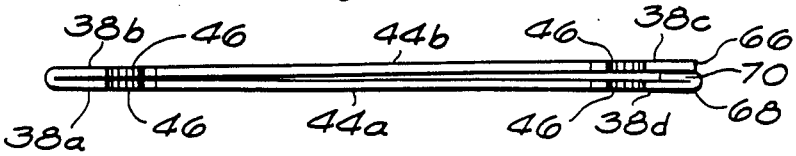
FIG. 4 is an end view of the drain stand in a collapsed configuration, taken generally along the line 4—4 of FIG. 3.

The drain stand 24 can be conveniently manufactured utilizing two alternate preliminary methods. The first, illustrated in FIGS. 2–4, requires that a single rectangular piece of base material 64 be folded along the mirror-image fold line 36 (which is perpendicular to the long axis of the base material), to place the opposite free ends 66 and 68 of the base material 64 generally adjacent one another. One free end 68 is provided an attachment panel 70 intended to facilitate attachment of the free ends 66 and 68 by a glue adhesive or the like. The mirror-image fold line 36 provides a reference from which the base material 64 is cut and folded, whereby a cut or fold on one side of the mirror-image fold line is generally duplicated on the other side. The folding of the base material 64 prior to any cutting thereof ensures the creation of a symmetrical drain stand 24.

After the base material 64 has been so folded and the free ends 66 and 68 attached to one another, the base material is then cut and stamped in a single operation to form the various elements of the drain stand 24 described above. More particularly, a pair of cuts 72 would be made to separate the inner support panels 42 from the side wall panels 38. Further cuts would be made to create the slots 58, the apertures 62 and the locking tabs 46. To facilitate assembly of the drain stand 24, several fold lines are also provided.

Specifically, a fold line 74 is provided between the end wall panels 40 and the inner support panels 42. Further, fold lines 76 define the boundary between the end wall panels 40 and the side wall panels 38. Additional fold lines 78 and 80 are provided between the inner support panels 42 and the guide panels 44, and also between the guide panels 44 and the locking tabs 46.

As illustrated in FIGS. 5 and 6, however, the cutting of the base material 64 need not take place after the base material has been folded about the mirror-image fold line 36. Rather, the base material 64 can be cut while still unfolded, and then subsequently folded along the mirror-image fold line 36. The free ends 66 and 68 may also be subsequently attached together with the attachment panel 70.

With reference now to FIG. 7, after the base material 64 has been folded, cut, and its free ends 66 and 68 attached to one another, the two opposing sides of the base material 64 are separated from one another in a manner spacing the end wall panels 40*a* and 40*b* from one another, but leaving the side wall panels 38*a* and 38*b*, and the side wall panels 38*c* and 38*d* attached to one another. This separation of the two opposing sides of the base material 64 effectively creates a definable interior 34 of the drain stand 24. The inner support panels 42 would then be bent upwardly and inwardly along their fold line 74 with the end wall panels 40 to create the trough mentioned earlier.

Figure 8:
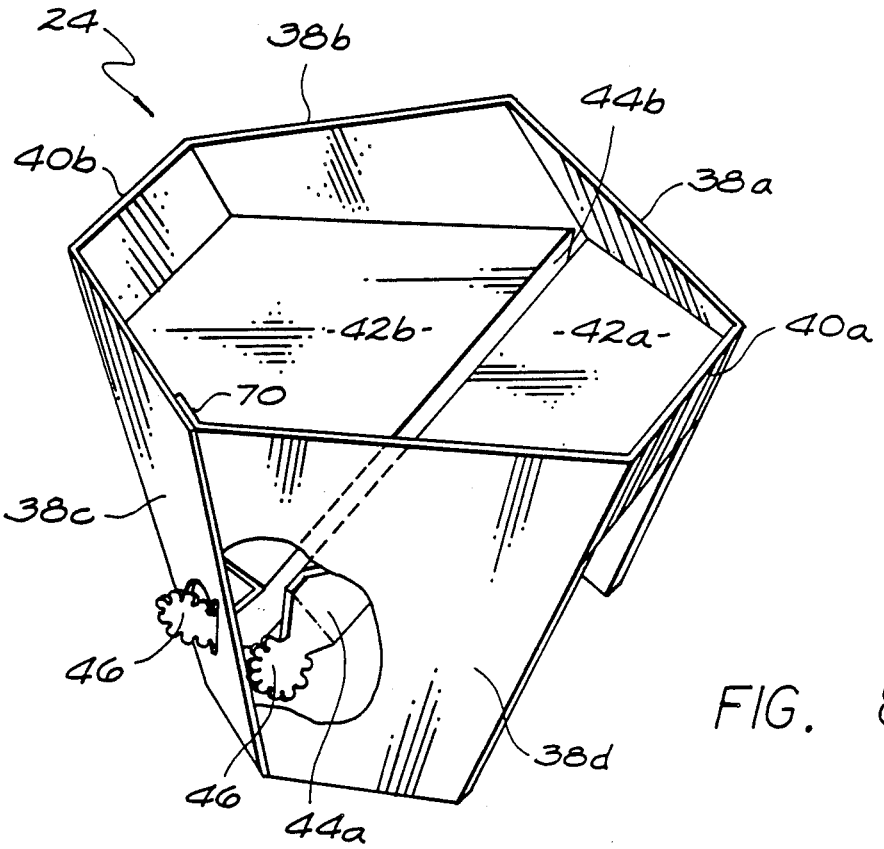
FIG. 8 is a perspective view illustrating assembly of the collapsible drain stand, specifically showing the manner in which locking tabs are inserted through adjacent slots for positioning the inner support panels.

The inner support panels 42 are rigidly positioned by inserting the locking tab head 52, the neck portion 50 and the strap portion 48 of the locking tab 46 through the adjacent slot 58 (FIG. 8). Once fully inserted, the locking tab 46 is bent along the fold line 80 to place the locking tab head 52 next to the aperture 62. The locking tab head 52 is then pushed through the aperture 62 in a manner deforming the locking tab head as it passes through the aperture, but permitting the locking tab head to resiliently resume a shape having dimensions larger than those of the aperture after passing therethrough. This is facilitated by the provision of the nodules 56 which tend to easily pass through the aperture 62, but because their diametric dimension is greater than that of the aperture 62, they resist being withdrawn back through the aperture. To further ensure that the locking tab head 52 remains within the aperture 62, the locking tab anchor 60 engages a face 82 of the locking tab head 52 in the manner illustrated in FIGS. 14 and 15.

After the drain stand 24 has been so constructed, the bag 22 is then preferably drawn through the bottom of the drain stand between the oppositely facing guide panels 44*a* and 44*b*. The open end 26 of the plastic bag 22 is then preferably stretched over the upper end of the drain stand 24 as illustrated in FIGS. 1 and 11. Since the side wall panels 38 provide drain stand legs effectively elevating the inner support panels 42 above the supporting surface, the bag 22 may conveniently extend between these legs outwardly from the drain stand 24 in a manner conveniently accommodating bags 22 of varying lengths. Oil or other fluids may then be conveniently drained through the open end 26 of the plastic bag 22 as illustrated in FIG. 1.

After the oil has been completely drained, the drain plug (not shown) would typically be replaced into the drain 32, the portion of the plastic bag 22 adjacent its open end 26 pulled upwardly and over the upper surface of the drain stand 24, and then the bag 22 would be carefully pulled downwardly through the trough between the guide panels 44*a* and 44*b* and the opposing ends of the inner support panels 42*a* and 42*b* to remove the bag from the drain stand 24. This bag 22 could then be conveniently sealed and transported to an appropriate disposal site, such as an oil recycling center, for disposal in a safe, convenient and ecologically sound manner.

As illustrated in FIG. 16, one method of sealing off the open end 26 of the bag 22 would be to twist the bag to form a rope-type effect, then tie an overhand knot into that upper portion of the plastic bag. Above the overhand knot the roped portion of the bag could then be doubled over and then secured by a tie strap 84 having a securing mechanism 86 which interacts with small rachet teeth 88.

From the foregoing it is to be appreciated that the fluid collection and disposal apparatus 20 of the present invention can be inexpensively manufactured, is convenient to use, and provides a safe and efficient means for properly disposing hazardous waste fluids, such as engine crankcase oil. The apparatus 20 can be shipped in a flat condition, unfolded quickly for use, and lends itself well to promotional uses by manufacturers in connection with other types of goods. In this regard, it should be apparent that the base material 64, either before or after the cutting and stamping procedure, can be printed with a manufacturer's logo or other advertisements. Additionally, the novel apparatus described eliminates the clean up of parts after the oil has been drained, and provides a very convenient means for transporting the oil to a recycling center.

Although a particular embodiment of the invention has been described in detail for purposes of illustration, various modifications may be made without departing from the spirit and scope of the invention. Accordingly, the invention is not to be limited, except as by the appended claims.

I claim:

1. A fluid collection and disposal apparatus useful in collecting oil draining from an engine crankcase, the apparatus comprising:

a fluid impermeable plastic bag for receiving and holding the oil drained from the crankcase, the bag having one open end; and a collapsible drain stand having a pair of rigid yet bendable board members, each board member including:

two side wall panels separate and distinct from one another, each side wall panel being connected to a respective side wall panel of the other board member, the side wall panels providing supporting legs for the drain stand, an end wall panel situated between and connected to the side wall panels at end wall/side wall fold lines, the end wall panel being situated in a different plane than the side wall panels, the end wall panels, in connection with the side wall panels of both board members, forming an upper edge of the drain stand and defining a drain stand interior, an inner support panel connected to a lower edge of the end wall panel at a support panel/end wall panel fold line, the inner support panel being inclined from its connection to the end wall panel downwardly and toward the interior of the drain stand to form a trough sufficiently wide to permit oil to flow easily therethrough, yet narrow enough to prevent larger solid objects from falling therethrough, a guide panel connected to a lower edge of the inner support panel opposite the end wall panel, the guide panel having two ends and extending generally downwardly in a different plane from that of the inner support panel, a locking tab at each end of the guide panel, and means for securing the locking tabs to the side wall panels;

whereby the plastic bag may be pulled upwardly between the guide panels and over the inner support panels, and the open end of the bag may be stretched over the upper edge of the drain stand, the bag being permitted to extend from the upper edge of the drain stand downwardly through the trough and then outwardly away from the drain stand between the side wall panels of one of the board members.

2. A fluid collection and disposal apparatus as set forth in claim 1, wherein each locking tab includes a strap extending from the guide panel and a locking tab head connected to the strap, and wherein each locking tab securing means includes a slot through the adjacent side wall panel dimensioned to permit passage of the strap and locking tab head therethrough, and further including an aperture through the adjacent side wall panel and situated generally adjacent the slot, the aperture having slightly smaller dimensions than the locking tab head whereby the locking tab and the adjacent side wall panel can be joined without adhesives by passing the locking tab head and the strap through the slot, then bending the strap to place the locking tab head next to the aperture, and finally by pushing the locking tab head through the aperture in a manner deforming the locking tab head as it passes through the aperture, but permitting the locking tab head to resiliently resume a shape having dimensions larger than those of the aperture after passing therethrough.

3. A fluid collection and disposal apparatus, comprising:

a fluid impermeable bag-like enclosure means for receiving and holding fluids to be collected, the enclosure means having an open end; and a collapsible drain stand for holding the enclosure means in a manner facilitating flow of fluids to be collected into the enclosure means, the drain stand including means for engaging the open end of the enclosure means to hold it in an open, fluid receiving position, means for funneling fluid drained through the enclosure means open end to the remainder of the enclosure means in a manner preventing larger solid objects from entering the enclosure means, and means for positioning the engaging means and the funneling means so that substantially all of the fluids to be collected drain into the enclosure means;

wherein the drain stand more particularly comprises two generally rectangular sheets of material connected to one another at their ends and which are pulled apart to form a continuous outer perimeter of the drain stand and to define a drain stand interior therebetween, each sheet of material including a primary body portion extending lengthwise from end-to-end, the upper edge of this primary body portion forming at least part of the engaging means, and the lower edge of this primary body portion forming at least part of the positioning means, each sheet of material further including an inner support panel attached at its upper edge to the primary body portion, which inner support panel is inclined downwardly into the drain stand interior to form at least a portion of the funneling means.

4. A fluid collection and disposal apparatus as set forth in claim 3, wherein each inner support panel is further attached to the primary body portion by releasable locking tab means.

5. A fluid collection and disposal apparatus as set forth in claim 4, wherein the releasable locking tab means includes:

a locking tab including a strap extending from a portion of the inner support panel, and a locking tab head connected to the strap;

a slot through the primary body portion dimensioned to permit passage of the strap and locking tab head therethrough; and an aperture through the primary body portion and situated generally adjacent the slot, the aperture having slightly smaller dimensions than the locking tab head;

whereby the inner support panel and the primary body portion can be joined together without adhesives by passing the locking tab head and the strap through the slot, then bending the strap to place the locking tab head next to the aperture, and finally by pushing the locking tab head through the aperture in a manner deforming the locking tab head as it passes through the aperture, but permitting the locking tab head to resiliently resume a shape having dimensions larger than those of the aperture after passing therethrough.

6. A fluid collection and disposal apparatus as set forth in claim 5, including a locking tab anchor at least partially resiliently hinged to one side of the aperture, whereby as the locking tab head is pushed through the aperture, the locking tab anchor engages the locking tab head to prevent its passage back through the aperture.

7. A fluid collection and disposal apparatus as set forth in claim 3, including a guide panel attached to each inner support panel, and extending downwardly and slightly outwardly therefrom to facilitate passage of the enclosure means upwardly through the drain stand.

8. A fluid collection and disposal apparatus as set forth in claim 3, wherein the funneling means and the positioning means permit the enclosure means to extend from the engaging means, through the interior of the drain stand, and then outwardly from the drain stand.

9. A fluid collection and disposal apparatus, comprising:

a fluid impermeable bag-like enclosure means for receiving and holding fluids to be collected, the enclosure means having an open end; and a drain stand which can be folded flat for shipping and packaging and unfolded for holding the enclosure means in a manner facilitating the flow of fluids to be collected into the enclosure means, the drain stand including a primary body portion which forms a continuous outer perimeter of the drain stand and defines a drain stand interior, and an inner support panel attached to the primary body portion, which inner support panel is inclined downwardly into the drain stand interior, wherein the primary body portion provides means for engaging the open end of the enclosure means in an open, fluid receiving position, and wherein the inner support panel provides means for funneling the fluid drained through the enclosure means open end to the remainder of the enclosure means in a manner preventing larger solid objects which may enter the open end of the enclosure means from passing by the funneling means into the remainder of the enclosure means.

10. A fluid collection and disposal apparatus as set forth in claim 9, including releasable locking tab means for attaching the inner support panel to the primary body portion.

11. A fluid collection and disposal apparatus as set forth in claim 10, wherein the releasable locking tab means includes:

a locking tab including a strap extending from a portion of the inner support panel, and a locking tab head connected to the strap;

a slot through the primary body portion dimensioned to permit passage of the strap and locking tab head therethrough; and an aperture through the primary body portion and situated generally adjacent the slot, the aperture having slightly smaller dimensions than the locking tab head;

whereby the inner support panel and the primary body portion can be joined together without adhesives by passing the locking tab head and the strap through the slot, then bending the strap to place the locking tab head next to the aperture, and finally by pushing the locking tab head through the aperture in a manner deforming the locking tab head as it passes through the aperture, but permitting the locking tab head to resiliently resume a shape having dimensions larger than those of the aperture after passing therethrough.

12. A fluid collection and disposal apparatus as set forth in claim 9, including a guide panel attached to the inner support panel, and extending downwardly and slightly outwardly therefrom to facilitate passage of the enclosure means upwardly through the drain stand.

13. A fluid collection and disposal apparatus as set forth in claim 9, wherein the primary body portion includes a plurality of spaced-apart legs for supporting the inner support panel above a supporting surface, wherein the enclosure means is permitted to extend from an upper edge of the drain stand, through the interior thereof, and then outwardly through the drain stand legs.

14. A fluid collection apparatus, comprising:

at least two rigid sheets connected to one another at their ends, the at least two sheets being pulled apart from an initially folded flat configuration to form a drain stand and to define a drain stand interior therebetween;

an inner support panel extending from one of the sheets inwardly and downwardly into the drain stand interior to form a trough sufficiently wide to permit fluid to flow therethrough, yet narrow enough to prevent larger solid objects from falling therethrough; and a fluid impermeable bag-like enclosure means for receiving and holding fluids to be collected, the enclosure means having an open end which engages the drain stand in a manner holding the end in an open, fluid receiving position, an intermediate portion extending from the open end to the trough, and a closed-end portion extending through and beyond the trough.

15. A fluid collection apparatus as set forth in claim 14, wherein the inner support panel is attached to at least one of the sheets by releasable locking tab means.

16. A fluid collection apparatus as set forth in claim 15, wherein the releasable locking tab means includes:

a locking tab including a strap extending from a portion of the inner support panel, and a locking tab head connected to the strap;

a slot through the sheet dimensioned to permit passage of the strap and locking tab head therethrough; and an aperture through the sheet and situated generally adjacent the slot, the aperture having slightly smaller dimensions than the locking tab head;

whereby the inner support panel and the at least one sheet can be joined together without adhesives by passing the locking tab head and the strap through the slot, then bending the strap to place the locking tab head next to the aperture, and finally by pushing the locking tab head through the aperture in a manner deforming the locking tab head as it passes through the aperture, but permitting the locking tab head to resiliently resume a shape having dimensions larger than those of the aperture after passing therethrough.

17. A fluid collection apparatus as set forth in claim 16, including a locking tab anchor at least partially resiliently hinged to one side of the aperture, whereby as the locking tab head is pushed through the aperture, the locking tab anchor engages the locking tab head to prevent its passage back through the aperture.

18. A fluid collection apparatus as set forth in claim 14, including a guide panel attached to the inner support panel and extending downwardly and outwardly therefrom to facilitate passage of the enclosure means upwardly through the trough.

19. A fluid collection apparatus as set forth in claim 14, wherein the at least two rigid sheets include a plurality of spaced-apart legs for supporting the inner support panel above a supporting surface, wherein the enclosure means is permitted to extend from an upper edge of the drain stand, through the interior thereof, and then outwardly through the legs.

* * * * *